United States Patent [19]

Siebold et al.

[11] Patent Number: 4,603,592

[45] Date of Patent: Aug. 5, 1986

[54] OFF-VERTICAL PUMPING UNIT

[75] Inventors: Quentin R. Siebold; Walter Labuhn, both of Calgary, Canada

[73] Assignee: Legrand Industries Ltd., Calgary, Canada

[21] Appl. No.: 542,109

[22] Filed: Oct. 14, 1983

[30] Foreign Application Priority Data

Jul. 28, 1983 [CA] Canada ..... 433460

[51] Int. Cl.[4] ..... F16H 21/32

[52] U.S. Cl. ..... 74/41; 166/72; 74/108

[58] Field of Search ..... 74/41, 108; 166/75 R, 166/72; 175/61, 203

[56] References Cited

U.S. PATENT DOCUMENTS

| | | | |
|---|---|---|---|
| 1,699,675 | 1/1929 | Reschke | 74/41 |
| 1,992,743 | 2/1935 | Durham | 74/579 |
| 2,079,276 | 5/1937 | Bloss | 74/41 |
| 2,092,180 | 9/1937 | Porter | 74/41 |
| 3,144,778 | 8/1964 | Lott | 74/41 |
| 3,371,554 | 3/1968 | McCray et al. | 74/41 |
| 4,121,471 | 10/1978 | Chancellor | 74/41 |

FOREIGN PATENT DOCUMENTS

| | | | |
|---|---|---|---|
| 1011796 | 8/1977 | Canada . | |
| 1051267 | 3/1979 | Canada . | |
| 1085230 | 9/1980 | Canada . | |
| 673253 | 3/1939 | Fed. Rep. of Germany | 74/41 |

*Primary Examiner*—Charles J. Myhre
*Assistant Examiner*—David A. Okonsky

[57] ABSTRACT

A pumping unit or pump jack, of the walking beam type of class I geometry, is provided which is arranged to permit relatively efficient pumping of a well inclined to the vertical, by suitable selection of beam support configuration and location, horsehead size, configuration and position, and position of the beam support fulcrum and beam length. Also provided is an adjustable pumping unit arranged to relatively efficiently pump wells ranging from about 0° to 45° off-vertical, in that the pitman is adjustable in length and the angle of inclination of the longitudinal axis of the samson post is adjustable.

20 Claims, 9 Drawing Figures

OFF-VERTICAL PUMPING UNIT

FIELD OF THE INVENTION

This invention relates to pumping units of the walking beam-type which are adapted to elevate oil or other liquid to the surface from wells.

BACKGROUND OF THE INVENTION

Conventional pumping units of the walking beam-type are designed to convert high speed, low torque rotary motion into low speed, high load reciprocating motion. These units typically include a walking beam, a prime mover, a gear reducer, crankarms attached to the gear reducer, pitman arms and an equalizer beam connecting the crank arms to the walking beam, a samson post which pivotally supports the walking beam, a horsehead attached to one end of the walking beam for supporting a polished rod load, crankarm counterweights, and various bearing assemblies. This type of pumping unit, which is generally referred to as a pump jack, has been used for many years to pump oil from vertical wells.

Recently, there has been some interest in bringing oil to the surface by means of off-vertical wells or slant hole wells. One advantage in using off-vertical wells to bring oil to the surface is that it requires the use of lens surface land. Less land is needed, since a large number of slant hole wells can be drilled adjacent to one another at a single central location (in a circular pattern, for example), in order to pump oil from a given formation, as opposed to a number of separate regularly spaced locations as is required for vertical wells. Thus, considerably less land is required for the pumping operation itself. In addition, the need for the use of land for access roads and the like is also correspondingly reduced. In some cases, as little as one tenth the land required for pumping purposes by vertical wells is needed in the case of pumping by off-vertical wells. Slant hole drilling is thus advantageous in urban areas or areas which are being farmed or otherwise utilized. It is also advantageous in swamp lands where it is difficult to construct mounting pads, or for drilling under rivers, lakes or offshore, where a vertical well would require the construction of an artificial island or the like. A slant hole well also enables the pumping of a formation which is located directly below a building or other obstruction. Slant hole drilling is particularly advantageous in drilling shallow wells which cannot be drilled by means of directional drilling (which involves drilling vertically for a considerable distance, then gradually deviating from the vertical).

Conventional pumping units of the walking-beam type are, however, designed to efficiently pump vertical wells only. Pumping a slant hole which deviates from the vertical by more than only a few degrees by means of an unmodified conventional pumping unit is unsatisfactory, for a number of reasons. The wire sling attached to the polished rod would not wind up and unwind cleanly along the horsehead arc, which would result in the imparting of a lateral deflection into the polished rod, which would damage the wellhead. The wire sling itself would tend to wear rapidly and break. Non-vertical forces greatly exceeding the design criteria of conventional pumping units would be exerted on the samson post. A clearance problem would also result, since the base of the pumping unit would have to be positioned too close to or on top of the well.

Some attempts have been made to pump off-vertical wells by means of pumping units of class III geometry having shorter than usual pitman arms. A class III unit is to be distinguished from a class I unit in that in the former unit, the pitman arms are connected to the walking beam between the samson post and the horsehead, whereas in the latter unit the samson post is connected to the walking beam between the pitman arms and the horsehead. Reference may be made to the "API Specification for Pumping Units" API STD 11E, Twelfth Edition, January 1982 regarding the distinction between a class I lever system and a class III lever system.

Shortening the pitman arms of the class III unit is directed at solving the above-noted problems of lateral deflection and rapid string water. However, reducing the length of the pitman arms to any extent increases the torque exerted on the gear reducer, thus reducing the efficiency of the pumping unit. As a result, gear reducers and motors of increased capacity are required. Operating costs are thus increased in areas in which electricity charges are based upon peak power consumption. Furthermore, shortening the pitman arms results in decreased wellhead clearance.

SUMMARY OF THE INVENTION

It has been found that off-vertical wells inclined at angles of up to 45° off-vertical can be pumped, without incurring the above-noted disadvantages associated with known configurations of class I and class III pumping units, by means of a modified class I pumping unit.

Accordingly, the present invention provides a pumping unit of the walking beam type of class I geometry, having a source of rotary motive power, a crank driven by the source of rotary motive power, a pitman pivotally connected at one end to the crank and pivotally connected at the other end to one end of a beam, a beam support for pivotally supporting the beam at a fulcrum, and a horsehead at the other end of the beam having a convex arcuate surface for supporting a wire sling connectable to a remote pump, the pumping unit being arranged to permit relatively efficient pumping of a well inclined to the vertical, in that the beam support configuration and location are selected to maintain the resultant forces thereon by the beam as substantially compressive forces; the size, configuration and position of the horsehead are selected to maintain within the arcuate surface of the horsehead the lowermost point of contact of the wire sling therewith over the range of oscillatory motion of the beam, while maintaining the notional line joining the lowermost point of contact and the fulcrum substantially perpendicular to the line of inclination of the well; and the position of the fulcrum and length of the beam are selected so that the beam support does not intersect nor interfere with the wellhead.

Preferably, the pumping unit is modified in that the combination of the size, configuration and position of the horsehead and the length of the pitman is selected so as to maintain within the arcuate surface of the horsehead the lowermost point of contact of the wire sling therewith over the range of oscillatory motion of the beam.

It has been recognized that if one desires to pump oil from a large formation by means of a number of slant hole wells drilled near each other, then it is generally necessary to drill such wells at various different angles to the vertical. For instance, usually one well will be drilled vertically to access oil located directly below the central pad. Other wells will also usually have to be drilled at large angles to the vertical in order to access the oil located in distant portions of the formation. Still other wells will have to be drilled at various angles between the vertical and the maximum off-vertical angle in order to access oil located at intermediate points in the formation. In this instance, a number of pumping units set up to pump at various angles to the vertical would be needed.

It has been found that the need to have a number of pumping units set up to pump oil from a number of wells inclined at various off-vertical angles is satisfied in a particularly convenient fashion by means of a single pumping unit of adjustable configuration.

There are a number of advantages associated with a single pumping unit of adjustable configuration, as opposed to a number of different units, each set up for only one pumping angle. Such an adjustable unit reduces the number of different component parts. An adjustable unit can be quickly switched from one setting to another, under field conditions, in the event that a well goes dry or becomes otherwise non-economical to pump. The need to preorder a number of pumping units set up to pump at specific angles is obviated. Further, since drilling rigs do not always drill at an accurate angle of inclination, any adjustment in pumping angle required due to inaccurate drilling may be compensated for more easily.

Accordingly, the present invention also provides a pumping unit of the walking beam type of class I geometry, having a source of rotary motive power, a crank driven by the source of rotary motive power, a pitman pivotally connected at one end to the crank and at the other end to one end of a beam, a samson post pivotally supporting the beam at a fulcrum, and a horsehead at the other end of the beam having a convex arcuate surface for supporting a wire sling connectable to a remote pump, the pumping unit being arranged to be an adjustable pumping unit capable of relatively efficiently pumping a well having an angle of inclination in the range from about 0° to about 45° to the vertical, in that, for a given well having an angle of inclination within the said range, the pitman arm is adjustable in length, the length thereof being increased with increasing angle of inclination of the well to the vertical, so as to maintain within the arcuate surface of the horsehead the lowermost portion of contact of the wire sling therewith over the range of oscillatory motion of the beam, while maintaining the notional line joining the said lowermost point of contact and the fulcrum substantially perpendicular to the line of inclination of the given well, and the angle of inclination of the longitudinal axis of the samson post is adjustable, the angle being increased with increasing angle of inclination of the well to the vertical, so as to maintain the resultant forces exerted on the samson post by the beam as substantially compressive forces, and so as to maintain sufficient clearance between the samson post and the wellhead of the given well.

A pumping unit made in accordance with the present invention is clearly better adapted to efficiently pump slant hole wells than unmodified conventional units of class I or class III geometry, since the present invention eliminates or reduces the problems of lateral deflection, excessive wire sling wear, samson post failure caused by improper matching of forces, and lack of clearance. The present invention is also superior to class III units modified to pump off-vertical wells by shortening the pitman arms thereof in that a pumping unit made in accordance with the present invention does not suffer from any significant reduction in efficiency when it is set up to pump an off-vertical well. The adjustable embodiment of the present invention is superior to conventional class I units in that it is capable of being adjustable in the field to pump at any angle from 0° to 45° off-vertical.

The invention will now be described, by way of example only, with reference to the following drawings, wherein like numerals refer to like elements throughout, and in which.

Figure 3A:
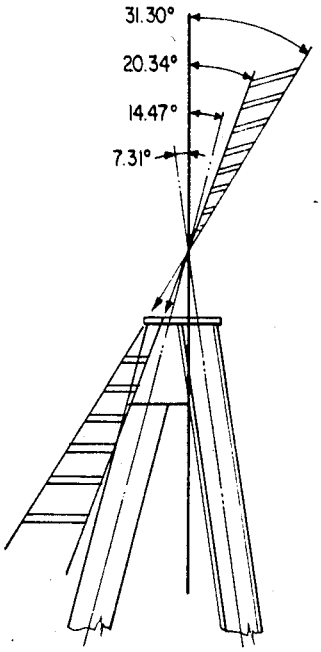
FIG. 3a PRIOR ART
Figure 3B:
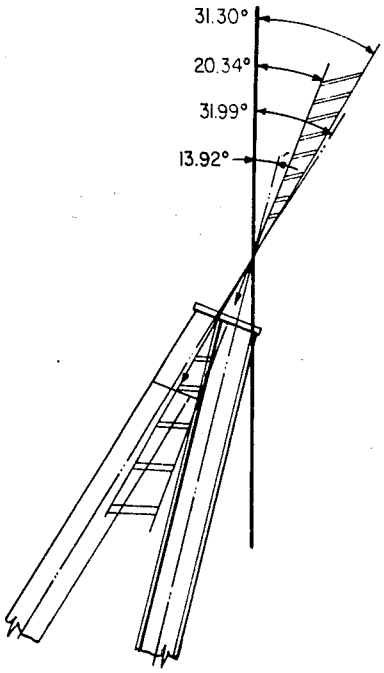
Figure 4:
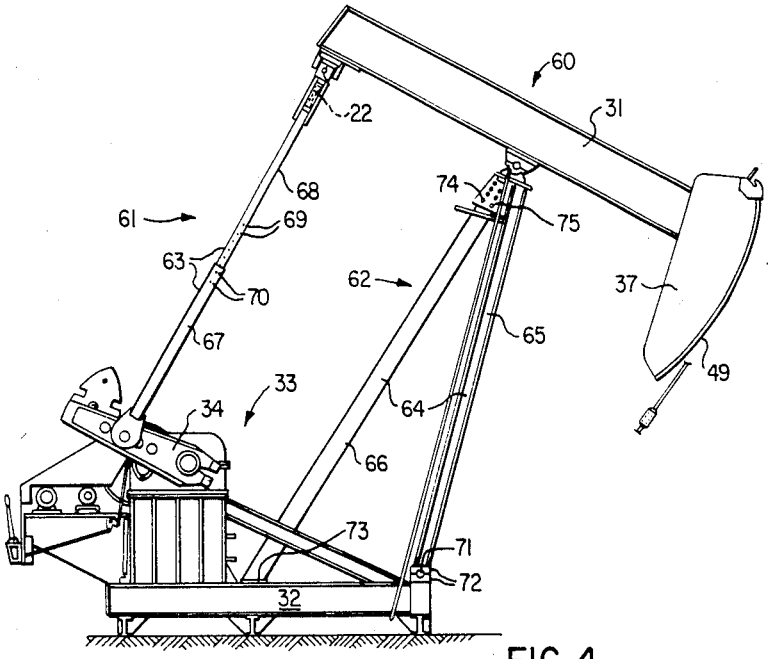
Figure 5:
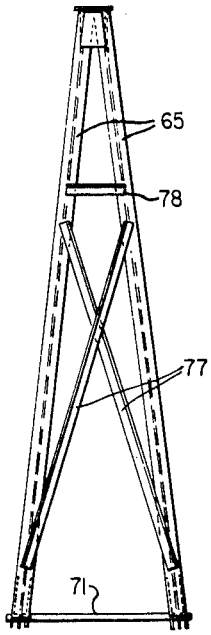
Figure 6:
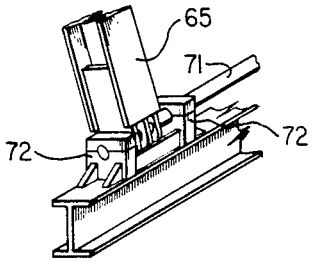
Figure 7A:
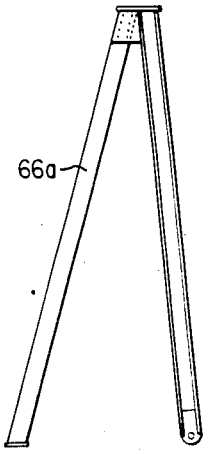
Figure 7B:
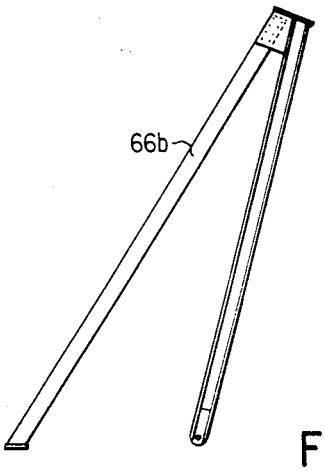

FIG. 3*a* is a diagram showing the resultant forces exerted on the samson post of a conventional pumping unit by the beam for a well inclined at 35° to the vertical;

FIG. 3*b* is a diagram showing the resultant forces exerted on the samson post of a pumping unit of the present invention by the beam for a well inclined at 35° to the vertical;

FIG. 4 is a side elevational view of a pumping unit modified in accordance with the present invention to be an adjustable pumping unit;

FIG. 5 is a front elevational view of the front legs of the samson post of the present invention;

FIG. 6 is a perspective view of the samson post front leg to base connection of the present invention;

FIG. 7*a* is a side elevational view of a samson post for a pumping unit of the present invention configured to pump wells of relatively small inclination to the vertical; and FIG. 7*b* is a side elevational view of a samson post for a pumping unit of the present invention configured to pump wells of relatively large angle of inclination to the vertical.

DETAILED DESCRIPTION OF THE PREFERRED EMBODIMENTS

Figure 1:
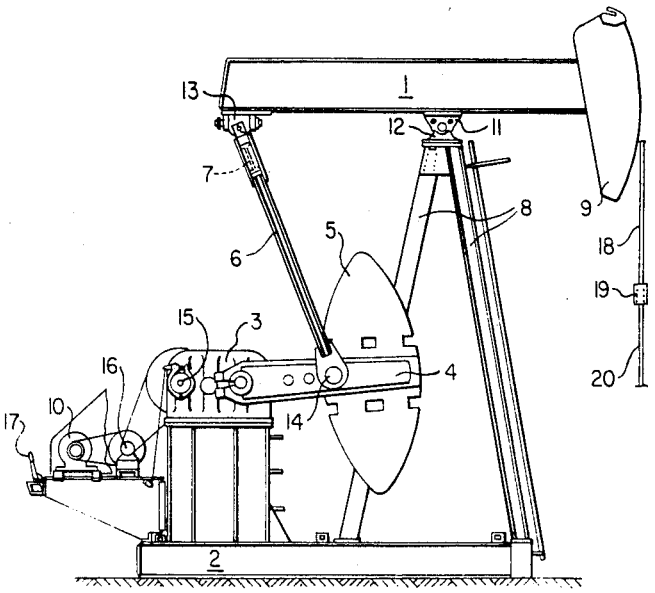
FIG. 1 PRIOR ART
FIG. 1 is a side elevational view of a conventional pumping unit.

A conventional pumping unit of class I geometry is shown in FIG. 1. This conventional unit typically comprises a walking beam 1, a base 2, a gear reducer 3, cranks 4, counterweights 5, pitman arms 6, equalizer beam 7, samson post 8, horsehead 9, and prime mover 10. The conventional unit also typically includes saddle bracket and clamp 11, saddle bearing assembly 12, equalizer bearing assembly 13, crankpin bearing assembly 14, brake drum assembly 15, and brake lever 17. The conventional unit is connected to a remote pump by means of wire rope sling 18, carrier bar 19, and rod string 20.

Figure 2:
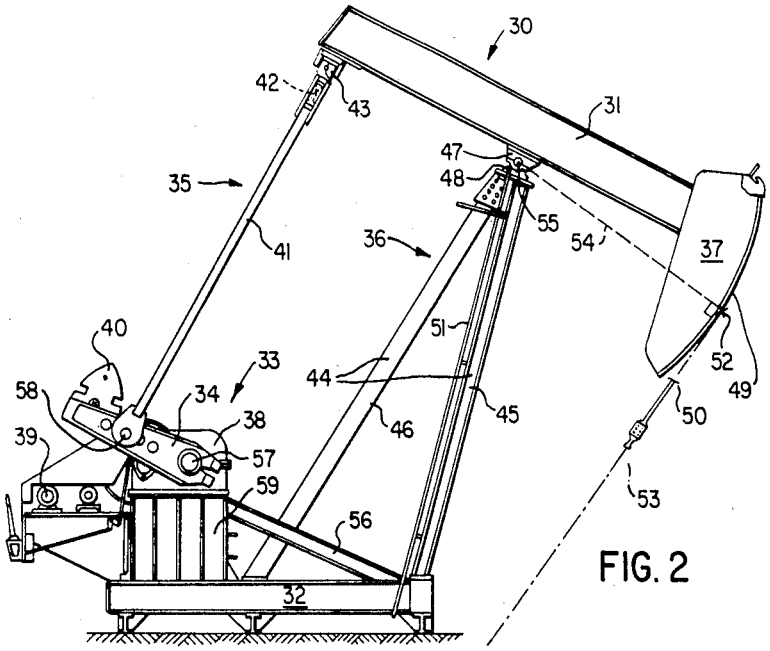
FIG. 2 is a side elevational view of a pumping unit modified in accordance with the present invention.

FIG. 2 illustrates an embodiment of a pumping unit 30 modified in accordance with the present invention. The pumping unit comprises a beam 31, a base 32, a source of rotary motive power designated generally as 33, crank 34 which is capable of being driven by the source of rotary motive power, pitman 35 which is pivotally connected at one end to the crank 34 and pivotally connected at the other end to one end of beam 31, a beam support designated generally as 36, and a horsehead 37 mounted at the front of the beam.

The source of rotary motive power 33 comprises a gear reducer 38 which is driven by prime mover 39, which may be an electric motor or gasoline engine. Crank 34 consists of a pair of crank arms, each of which are mounted on one end of shaft 57 of gear reducer 38. One or more balanceweights or counterweights 40 may be mounted if needed on crank 34.

Pitman 35 comprises a pair of pitman arms 41, and an equalizer beam 42. Each pitman arm is pivotally connected at its bottom end to crank 34 by means of crankpin bearing assembly 58, and is mounted at its top end to equalizer beam 42. Equalizer beam 42 is in turn pivotally connected to the back end of beam 31 by means of equalizer bearing assembly 43.

Beam support 36 is a tripod samson post 44 having a pair of front legs 45 and a rear leg 46. The samson post 44 is pivotally connected to the beam 31 by means of saddle bracket and clamp 47 and saddle bearing assembly 48. Alternatively, beam support 36 could be a tetrapod samson post having two rear legs.

Attached to the inside of front legs 45 is ladder and hoop 51. This ladder and hoop should be reversed to be attached to the outside of the front legs if the pumping unit is set up to pump wells of relatively small angle of inclination to the vertical. Support beam 56 extends between riser box 59 and a forward portion of base 32. Riser box 59 is used to elevate gear reducer 38 so that crank 34 clears the ground.

Horsehead 37 has convex arcuate surface 49, which is adapted to support wire rope sling 50. Wire sling 50 typically consists of a U-shaped loop of wire cable whose middle portion is looped over the top of the horsehead. The ends of wire sling typically extend below the horsehead and are connected to a carrier bar which is in turn connected to the polished rod. Alternatively, the wire sling could consist of a single cable.

All of the components of pumping unit 30 are conventional except for pitman arms 41, samson post 44 and horsehead 37. The gear reducer 38 is of conventional design; however, its horizontal position generally must be changed in order to help reduce the torque required of the reducer.

Horesehead 37 is selected to enable the pumping unit to pump wells whose angles of inclination vary over a range of several degrees (about 10°) without causing excessive wire sling wear and without imparting any lateral movement to the polished rod. In order to achieve this objective, the length and configuration of the horsehead and the position of the horsehead with respect to the well must be properly selected. The surface of the horsehead must define an arc of a circle, with radius at the fulcrum point 55. The horsehead must be positioned in relation to the well such that the line of inclination of the well 53 is tangent to the arcuate surface 49 of the horsehead. The horsehead is preferably positioned such that when the pumping unit is in its mid-stroke position, the point of tangency falls approximately in the middle of the arcuate surface 49. But in any event, the length of the arcuate surface 49 of horsehead 37 must be selected such that during operation of the pump, the lowermost point of contact 52 (i.e. the point of tangency) will be maintained within the arcuate surface of the horsehead over the entire range of oscillatory motion of the beam. If the length, configuration and position of the horsehead 37 are properly selected, the pumping unit of the present invention may be used to pump wells deviating from the vertical by several degrees, without having to make any modifications to the pitman arms or samson post. Since conventional horseheads are designed to pump at a single angle only, the arcuate surface 49 of horsehead 37 will generally be selected to be longer than that of a conventional horsehead. In the preferred embodiment, the arcuate surface 49 is lengthened by lengthening the portion of horsehead 37 which extends below beam 31. Point of contact 52 and fulcrum point 55 define notional line 54, which remains perpendicular to line of inclination of the well 53 during operation.

It is conceivable that the horsehead could be lengthened to about 2 or 3 times the size of a conventional horsehead, in order to pump wells having angles of inclination in a fairly wide range, and still keep the lowermost point of contact 52 within the arcuate surface 49 over the full range of oscillatory motion of the horsehead. However, such a large horsehead would have the undesirable characteristics of being heavy and unstable. Further, a clearance problem between the horsehead and the front legs of the samson post could result. Simply using a very large horsehead also does not alleviate the clearance problem between the wellhead and base of a conventional unit, which is discussed later.

Accordingly, in the present invention the pitman arms 41 are increased in length with increasing angle of well inclination. Doing so enables a horsehead of conventional size or slightly longer than conventional size to be used, to pump any well ranging from 0° to 45° off-vertical, while still keeping the wire sling tangent to the arc defined by the arcuate surface of the horsehead at all times during operation. Indeed, if a longer than usual pitman arm is utilized, then horsehead 37 need not necessarily be longer than a conventional horsehead, whose curved surface is typically a few inches longer than the maximum stroke length of the unit. However, it is preferable that the horsehead be somewhat longer than a conventional horsehead, to enable the pumping unit of the present invention to pump wells over a range of a few degrees (e.g. 8°–10°) of well inclination, without having to adjust the length of the pitman arms.

The length of the pitman arms is selected such that, for a particular pumping angle, the lowermost point of contact 52 lies at approximately the mid-point of arcuate surface 49, when the pumping unit is set up at its mid-stroke position. Such a selection results in the mean angle of the beam 31 during operation being generally perpendicular to the angle of inclination of the well 53. However, as in the preferred embodiment, the mean angle of the beam will not be exactly perpendicular to well line 53, if the majority of arcuate surface 49 lies below the beam, since then the angle of the beam at mid-stroke will not correspond to the angle of notional line 54, which must be perpendicular to well line 53.

Selecting the size, configuration and position of the horsehead and the length of the pitman arm is generally not, however, enough to solve all of the problems associated with modifying a conventional pumping unit to pump an off-vertical well, especially when the angle of inclination of the well deviates to any substantial extend from the vertical, because of the two further problems of mismatching of forces and lack of clearance.

At large pumping angles, the resultant force exerted on the samson post at the fulcrum by the beam (i.e. the sum of the force exerted by the weight of the beam, the force exerted by the polished rod load, and the force exerted by the pitman) tends to fall outside the angle subtended by the samson post, at least during some portions of the range of oscillatory motion. This results in putting either the front legs or rear leg alternately in compression and tension, which may cause slotting at any points of attachment or other forms of wear, resulting in premature failure of the samson post. It is therefore desirable that the resultant force on the samson post be substantially compressive, rather than shear or tensile, throughout the entire range of oscillatory motion.

The clearance problem is a lack of clearance between the wellhead and the bottom portions of the front legs of the samson post or the front of the base of the unit, for larger pumping angles. A conventional pumping unit having an upright samson post could not be used at larger pumping angles, since the geometry would dictate that the wellhead be located underneath the samson post or base of the unit.

The present invention solves these two problems of force mismatching and lack of clearance for large pumping angles by attaching the front legs of the samson post at the very front of the base, and inclining the samson post towards the well. The angle of inclination of the longitudinal axis of the samson post is increased as the angle of inclination of the well is increased. For the larger angles of well inclination, the fulcrum point of the samson post will be forwardly offset relative to the lowermost ends of the front legs of the samson post. Moving the fulcrum point forwardly results in sufficient base-to-wellhead clearance for pumping angles of up to 45° off-vertical.

This forward inclination of the samson post also results in keeping the resultant forces exerted thereon during operation within the angle subtended by the rear leg and front legs, as illustrated in FIG. 3. FIG. 3*b* shows that the range of resultant forces on the samson post, for a well inclined at 35° to the vertical, is from 20.34° to 31.30° to the vertical, which range falls within the angle subtended by an inclined samson post having forward and rear legs inclined at 13.92° and 31.99° to the vertical respectively. In contrast, FIG. 3*a* indicates that the resultant forces for a well again inclined at 35° to the vertical fall outside the angle subtended by a conventional samson post having forward and rear legs inclined at −7.31° and 14.47° to the vertical respectively. Thus in the present invention the resultant forces applied to the legs of the samson post at the fulcrum are substantially compressive forces rather than shear forces or tensile forces.

When making the modifications of the present invention, it must be borne in mind that a pumping unit must be balanced and properly phased in order for it to operate efficiently. To be balanced, the unit must be set up such that the couterweight counteracts to the extent possible the force exerted on the walking beam by the polished rod load. That is, the counterweight should provide a downward force during that part of the cycle when the polished rod load is being pulled upwardly against the force of gravity. Similarly, the counterweight must act as a load when the polished rod is being moved downwardly by the force of gravity. The object of this balancing and phasing exercise is to minimize and even out throughout the crank cycle the torque exerted on the gear reducer. After the modifications to the pitman arm and samson post of the present invention are effected, proper phasing can usually be achieved by repositioning the gear reducer along the plane of the base. It may also be necessary or desirable to mount the counterweights on one side only of each crank as shown in FIG. 2, or to use an offset crank, i.e. a crank having crankpin bearing assembly mounting positions which are not located along the longitudinal axis of the crank.

Other factors, such as the height of the samson post and the length of the walking beam, must be kept in mind and adjusted as is appropriate, especially for clearance considerations.

FIG. 4 illustrates an adjustable pumping unit made in accordance with the present invention. Adjustable pumping unit designated generally at 60 includes beam 31, base 32, a source of rotary motive power 33, crank 34 and horsehead 37 which are identical to the corresponding elements of the basic non-adjustable unit described with reference to FIG. 1. Adjustable pumping unit 60 differs from pumping unit 30 only in that the pitman is an adjustable pitman 61 and the beam support is an adjustable beam support 62. Adjustable pitman 61 comprises equalizer beam 22 and a pair of pitman arms 63 which are adjustable in length. Adjustable beam support 62 comprises samson post 64 having a pair of coplanar front legs 65 pivotally connected to the forward end of base 32, and rear leg 66 which is detachably securable to a rearward portion of base 32.

Each pitman arm 63 comprises two sections, an outer section 67 and an inner section 68, the inner section 68 being configured to be slideably engaged within outer section 67. Inner section 68 includes a series of apertures 69, and outer section 67 includes a pair of apertures 70. Adjustment of the length of pitman arm 63 is effected by sliding inner section 68 relative to outer section 67, so as to align the appropriate pair of inner sleeve apertures 69 with the pair of outer sleeve apertures 70, and inserting therein a pair of suitable fasteners to prevent further relative movement.

The front legs 65 of samson post 64 are pivotally connected at the bottoms thereof to the forward end of base 32 (relative to the motor/gear reducer or other source rotary motion which is mounted at the rear of the base) by means of bar 71 and clamps 72. Rear leg 66 has an angled base plate 73, and is detachably securable to base 32. The rear leg 66 is joined at its top to the tops of the front legs 65 by means of mounting assembly 75. To effect an adjustment of the angle of inclination of samson post 64, rear leg 66 must be removed by removing the fasteners 74 securing rear leg 66 to mounting assembly 75, loosening clamp 72, pivoting front legs 65 about bar 71, replacing rear leg 66 with a longer or shorter rear leg as desired, securing the longer or shorter rear leg by tightening fasteners 74, and securing front leg 65 by tightening clamp 72.

FIG. 5 is a front view of a pair of front legs 65, and shows the position of bar 71, and the position of angled reinforcement bar 77 and horizontal reinforcement bar 78.

FIG. 6 is a perspective view of the samson post front leg to base connection, providing details of clamps 72, and the connection between bar 71 and front leg 65.

Referring now to FIGS. 7*a* and 7*b*, rear leg 66 of samson post 64 is selected from a small number of rear legs of different pre-specified lengths. FIG. 7*a* illustrates a rear leg 66*a* of suitable length for pumping well ranging from about 0° to about 16° off-vertical. FIG. 7*b* illustrates a rear leg 66*b* of suitable length for pumping well ranging from about 16° to about 35° off-vertical.

The distance between adjacent apertures 69 of inner section 68 of pitman arms 63 is selected to make the pitman arms adjustable in increments of 5° of pumping angle. A finer degree of pitman arm adjustability is not necessary, since the arcuate surface 49 of horsehead 37 is made long enough to cover a range of about 8°-10° of pumping angle. The horsehead is not user adjustable.

It has been found that only about three adjustments in the angle of inclination of the samson post are needed to keep the resultant forces exerted by the beam within the angle subtended by the legs of the samson post for the entire range of pumping angles from 0° to about 45°. Accordingly, the adjustable pumping unit 60 of the present invention utilizes three legs of different lengths, a short one covering the range from about 0° to about 16° of pumping angle, a longer one to cover the range from about 16° to about 36°, and a still longer one to cover the range from about 36° to 45°.

In order to adjust the pumping unit to efficiently pump a well inclined at a given off-vertical angle, at most only two adjustments of pumping unit components are needed: an adjustment of the pitman arm length and an adjustment of the samson post angle of inclination. In some cases, however, only an adjustment of the pitman arm length is necessary, if the old and new angles both fall within the range of a single samson post rear leg. In still other cases, where the difference in pumping angles is slight, no adjustment of components whatsoever is necessary, since the lengthened horsehead has sufficient range to accommodate either pumping angle. In all cases, however, the unit must be positioned with respect to the well such that the well line of inclination is tangent to the arcuate surface of the horsehead.

To give an example, assuming a pitman arm set up to be adjustable in increments of 5° starting at 1½° (i.e. 1½°, 6½°, 11½° . . . ), and a set of three samson post legs set up for 0–16, 16–36, and 36–45° respectively, then a change of pumping angle from 5° to 38° would require adjusting the pitman arm from the second to the eighth position, and replacing the shortest rear leg with the longest rear leg.

The geometry of adjustable unit of the present invention is selected (e.g. the position of the gear reducer) such that the unit is in a reasonably good degree of phasing throughout the entire range of pumping angles from 0° to 45° off-vertical. The position of the gear reducer is not user adjustable in the preferred embodiment of the adjustable unit. It is realized that this lack of adjustability could lead to some reduction in efficiency for certain pumping angles, due to improper phasing.

Nevertheless, it was found that the efficiency of the adjustable pumping unit is not decreased to any substantial degree when it is adjusted from a 0° pumping angle to a large off-vertical pumping angle. The following tables contain the results of a computer calculation illustrating that the torque factors resulting from the operation of a pump modified in accordance with the present invention are not substantially increased (the lower the torque factor the better) when pumping at large off-vertical pumping angles. The torque factor TF at a given angle is related to to torque T on a pumping unit gear reducer as a result of a polished rod load W, in that the $TF=T/W$. Table 1 contains the torque factors resulting when a pumping unit made in accordance with the present invention is set up to pump at 0° off-vertical, whereas Table 2 lists the torque factors resulting from a similar pumping unit set up to pump at 35° off-vertical. Both units have the pitman pivotally connected to the crank at a crank length radius of 35.8" and a stroke length of about 86". In the case of the 0° pumping angle unit, the maximum torque factors are 43.99 at 60° and −42.26 at 270°. In the case of the pumping unit set up to pump at 35°, the maximum torque factors are 44.22 at 90° and −41.78 at 300°.

Furthermore, it has been found that the efficiency of the pumping unit of the present invention throughout its range of possible pumping angles rivals that of conventional class I pumping units of comparable specifications.

One desirable feature of the present invention is that it enables the retention of the use of common components of a conventional pumping unit, except for the samson post and the pitman arms. Utilizing the vast majority of components from conventional pumping units is advantageous in that ease of maintenance, reliability and efficiency of conventional pumping unit components are retained.

TABLE 1

UNIT DESIGNATION: 160-173-86 (OVP-0 DEGREE)
STROKE LENGTH = 85.317 (INCHES)
FOR A CRANK LENGTH RADIUS OF 35.8 (INCHES)

| CRANK ANGLE | TORQUE FACTOR | ROD HT. |
|---|---|---|
| 0. | 4.3595 | 0.0020 |
| 15. | 18.8797 | 0.0378 |
| 30. | 31.5027 | 0.1159 |
| 45. | 40.1674 | 0.2271 |
| 60. | 43.9951 | 0.3574 |
| 75. | 43.5052 | 0.4926 |
| 90. | 39.9670 | 0.6213 |
| 105. | 34.6221 | 0.7361 |
| 120. | 28.2950 | 0.8328 |
| 135. | 21.3668 | 0.9091 |
| 150. | 13.9072 | 0.9634 |
| 165. | 5.8445 | 0.9939 |
| 180. | −2.8533 | 0.9986 |
| 195. | −11.9993 | 0.9759 |
| 210. | −21.0814 | 0.9250 |
| 225. | −29.3293 | 0.8474 |
| 240. | −35.9529 | 0.7467 |
| 255. | −40.3707 | 0.6290 |
| 270. | −42.2621 | 0.5015 |
| 285. | −41.4727 | 0.3723 |
| 300. | −37.8944 | 0.2498 |
| 315. | −31.4154 | 0.1428 |
| 330. | −21.9821 | 0.0601 |
| 345. | −9.7981 | −0.0107 |

TABLE 2

UNIT DESIGNATION: 160-173-86 (OVP-35 DEGREE)
STROKE LENGTH = 85.815 (INCHES)
FOR A CRANK LENGTH RADIUS OF 35.8 (INCHES)

| CRANK ANGLE | TORQUE FACTOR | ROD HT. |
|---|---|---|
| 0. | −18.1825 | 0.0399 |
| 15. | −5.4776 | 0.0033 |
| 30. | 8.6885 | 0.0080 |
| 45. | 22.5143 | 0.0560 |
| 60. | 33.8951 | 0.1429 |
| 75. | 41.2713 | 0.2587 |
| 90. | 44.2251 | 0.3902 |
| 105. | 43.3507 | 0.5246 |
| 120. | 39.6707 | 0.6518 |
| 135. | 34.1251 | 0.7648 |
| 150. | 27.3507 | 0.8588 |
| 165. | 19.6891 | 0.9308 |
| 180. | 11.3025 | 0.9782 |
| 195. | 2.3224 | 0.9991 |
| 210. | −7.0109 | 0.9920 |
| 225. | −16.2690 | 0.9564 |
| 240. | −24.8582 | 0.8934 |
| 255. | −32.1486 | 0.8061 |
| 270. | −37.6157 | 0.6991 |
| 285. | −40.9029 | 0.5788 |
| 300. | −41.7867 | 0.4520 |
| 315. | −40.1000 | 0.3264 |
| 330. | −35.6784 | 0.2101 |

TABLE 2-continued

| UNIT DESIGNATION: 160-173-86 (OVP-35 DEGREE) STROKE LENGTH = 85.815 (INCHES) FOR A CRANK LENGTH RADIUS OF 35.8 (INCHES) | | |
|---|---|---|
| CRANK ANGLE | TORQUE FACTOR | ROD HT. |
| 345. | −28.3751 | 0.1117 |

A pumping unit made in accordance with the present invention can also be set up to be rotatable in either the clockwise or counterclockwise direction. This characteristic greatly increases the life of the gear reducer.

While in the preferred embodiment the modifications made in accordance with the present invention comprise selecting the length and position of the horsehead, the length of the pitman arms and the angle of inclination of the samson post, it will be apparent that other alternative embodiments of the present invention are possible.

In an alternative embodiment, the proper mean positioning of the walking beam is achieved by adjusting the vertical position of the gear reducer, rather than by adjusting the length of the pitman arms.

In another alternative embodiment, the rear leg of the samson post may be made adjustable by making it of two telescopically adjustable pieces, one pivotally connected to the base and the other pivotally connected to the saddle bearing mounting assembly, each piece being capable of being secured by clamp means.

In a further alternative embodiment, the entire base of the unit can be elevated at its end most remote from the well, thereby obtaining the desired samson post angle of inclination and mean position of the walking beam. In this embodiment, the front end of the gear reducer is preferably capable of being elevated to keep it level and allow it to be lubricated by conventional lubrication means. This alternative embodiment may be made adjustable by adjusting an angle of inclination of the base, by means of hydraulic jacks or the like. However, this embodiment may require the use of a modified mounting pad and base, a non-conventional gear reducer, and expensive elevation systems. Accordingly, this embodiment may not have all of the advantages of the preferred embodiments.

Those skilled in the art will appreciate that, while the present invention has been described and illustrated with respect to the preferred embodiments, variations of the preferred embodiments, including those discussed above, may be made without departing from the scope of the invention, which is defined in the appended claims.

We claim:

1. A pumping unit of a walking beam type of class I geometry, having a source of rotary motive power, a crank driven by the source of rotary motive power, a pitman pivotally connected at one end to the crank and pivotally connected at an opposite end to one end of a beam, a beam support for pivotally supporting the beam at a fulcrum, and a horsehead at an opposite end of the beam, said horsehead having a convex arcuate surface for supporting a wire rope sling connectable to a remote pump by means of a polish rod, said pumping unit being arranged to permit relatively efficient pumping of a well having a central axis inclined at an angle to geological vertical in a range from 10° to about 45° in that:

(a) the beam support configuration, the beam support location and angle of inclination to the vertical of a longitudinal axis of the beam support are selected to maintain resultant forces exerted by the beam on the beam support as substantially compressive forces;

(b) size, configuration and position of the horsehead are selected to avoid excessive wire rope sling wear and excessive lateral movement of the polish rod; and (c) the position of the fulcrum and length of the beam are selected so that the beam support does not intersect nor interfere with a wellhead.

2. The improvement of claim 1, wherein the pitman is adjustable in length, and the length thereof is increased with increasing angle of inclination of the well to the vertical.

3. The improvement of claim 1, wherein the mean angle of inclination of the beam during operation is generally perpendicular to the line of inclination of the well.

4. The improvement of claim 1, wherein the beam support is a samson post whose longitudinal axis is inclined to the vertical in the same sense as the well and wherein the samson post comprises a pair of coplanar front legs and at least one rear leg, and wherein said longitudinal axis is the line bisecting the angle between the pair of front legs and the at least one rear leg, and wherein the angle of inclination of said longitudinal axis is selected so as to maintain the resultant forces exerted thereon by the beam at the fulcrum within the angle subtended by the pair of front legs and the at least one rear leg.

5. The improvement of claim 4, wherein the angle of inclination of the longitudinal axis of the samson post is adjustable within a range of a few degrees to less than about 35° to the vertical.

6. The improvement of claim 4, wherein the forces in all the legs of the samson post are substantially compressive rather than tensile.

7. The improvement of claim 1, wherein the source of rotary motive power and the beam support are mounted on a base offset from the wellhead.

8. The improvement of claim 7, wherein the fulcrum is offset from the nearest point of the base in the direction of the wellhead.

9. The improvement of claim 7, wherein the base is substantially horizontal and the said selections are made without changing the substantially horizontal orientation of the base.

10. A pumping unit of a walking beam type of class I geometry, having a source of rotary motive power, a crank driven by the source of rotary motive power, a pitman pivotally connected at one end of the crank and pivotally connected at an opposite end to one end of a beam, a beam support for pivotally supporting the beam at a fulcrum, and a horsehead at an opposite end of the beam, said horsehead having a convex arcuate surface for supporting a wire rope sling connectable to a remote pump, said pumping unit being arranged to permit relatively efficient pumping of a well having a central axis inclined at an angle to geological vertical in a range from 10° to about 45° in that:

(a) the beam support configuration, the beam support location and angle of inclination to the vertical of a longitudinal axis of the beam support are selected to maintain resultant forces exerted by the beam on the beam support as substantially compressive forces;

(b) a combination of the size, configuration and position of the horsehead and the length of the pitman is selected so as to maintain within the arcuate surface of the horsehead a lowermost point of contact of the wire sling therewith over a full range of oscillatory motion of the beam, while maintaining a notional line joining the lowermost point of contact and the fulcrum substantially perpendicular to the inclined central axis of the well; and (c) the position of the fulcrum and length of the beam are selected so that the beam support does not intersect nor interfere with a wellhead.

11. A pumping unit of a walking beam type of class I geometry, having a source of rotary motive power, a crank driven by the source of rotary motive power, a pitman pivotally connected at one end to the crank and at an opposite end to one end of a beam, a samson post pivotally supporting the beam at a fulcrum, and a horsehead at an opposite end of the beam, said horsehead having a convex arcuate surface for supporting a wire sling connectable to a remote pump, the pumping unit being arranged to be an adjustable pumping unit capable of relatively efficiently pumping a well having a central axis inclined in a range of 0° to about 45° to geological vertical, in that, for a given well having a central axis inclined within said range;

(a) the pitman is adjustable in length, the length thereof being increased with increasing angle of inclination of the well to the vertical, so as to maintain within the arcuate surface of a horsehead a lowermost point of contact of the wire sling therewith over a full range of oscillatory motion of the beam, while maintaining a notional line joining the said lowermost point of contact and the fulcrum substantially perpendicular to the inclined central axis of the given well;

(b) the samson post comprises a pair of coplanar legs and at least one rear leg, wherein the samson post is adjustably positionable to so as to maintain sufficient clearance between the samson post and a wellhead of a given well.

12. The improvement of claim 11, wherein the pitman is an incrementally adjustable pitman adjustable in length in discrete increments, and wherein the arcuate surface of the horsehead is selected to be of sufficient length such that for any angle of inclination of the well from about 0° to about 45° to the vertical, the incrementally adjustable pitman is adjustable such that in operation the wire sling remains tangent to the arc defined by the arcuate surface of the horsehead.

13. The improvement of claim 11, wherein the forces in all the legs of the samson post are substantially compressive rather than tensile.

14. The improvement of claim 11, wherein the mean angle of inclination of the beam during operation is generally perpendicular to the line of inclination of the given well.

15. The improvement of claim 11, wherein the length of the pitman and the angle of inclination of the longitudinal axis of the samson post are selected to pump relatively efficiently a well having an angle of inclination in the range of about 10° to about 45° to the vertical.

16. The improvement of claim 11, wherein the source of rotary motive power and the samson post are mounted on a base offset from the wellhead.

17. The improvement of claim 16, wherein the fulcrum is offset from the nearest point of the base in the direction of the wellhead of the given well.

18. The improvement of claim 16, wherein the samson post is a tripod samson post having a pair of coplanar front legs lying in a plane perpendicular to the plane comprising the beam, and pivotally connected at the bottoms thereof to the forward end of the base, and a rear leg which is detachably secured to the base and is of adjustable length.

19. The improvement of claim 18, wherein the rear leg is selected from a group of legs of pre-selected different fixed lengths.

20. The improvement of claim 19, wherein the rear leg is selected from a group of three legs of pre-selected different fixed lengths, the shortest of the legs being for use with wells angled from about 0° to about 16° to the vertical, the middle leg being for use with wells angled from about 16° to about 36° to the vertical, and the longest leg being for use with wells angled from about 36° to about 45° to the vertical.

* * * * *